US005106025A

United States Patent [19]

Giroux et al.

[11] Patent Number: 5,106,025

[45] Date of Patent: Apr. 21, 1992

[54] COATING PRODUCT SPRAYER DEVICE WITH ROTARY SPRAYER MEMBER

[75] Inventors: Patrice Giroux, St Egreve; Gérard Degli, Uriage, both of France

[73] Assignee: SAMES, S.A., Meylan, France

[21] Appl. No.: 592,253

[22] Filed: Oct. 3, 1990

[30] Foreign Application Priority Data

Oct. 3, 1989 [FR] France ..... 89 12904

[51] Int. Cl.[5] ..... B05B 5.04; B05B 15/02

[52] U.S. Cl. ..... 239/703; 239/112

[58] Field of Search ..... 239/112, 113, 703

[56] References Cited

U.S. PATENT DOCUMENTS 3,155,539 11/1964 Juvinall ..... 118/11
3,224,680 12/1965 Burnside et al. ..... 239/112
4,505,430 3/1985 Rodgers et al. ..... 239/112

FOREIGN PATENT DOCUMENTS 8607841 5/1986 Fed. Rep. of Germany .
3912700 10/1990 Fed. Rep. of Germany ..... 239/112
2066701 7/1981 United Kingdom ..... 239/112
2142844 1/1985 United Kingdom ..... 239/703

*Primary Examiner*—Andres Kashnikow
*Assistant Examiner*—Karen B. Merritt
*Attorney, Agent, or Firm*—Spensley Horn Jubas & Lubitz

[57] ABSTRACT

An electrostatic coating product sprayer device is provided with quick cleaning means. The sprayer device comprises a rotatable sprayer member and at least one cleaning product nozzle fixed relative to the rotatable member. The nozzle is directed towards a generally convex surface of the rotatable member so that the jet from it impinges on the generally convex surface with a large angle of incidence. The nozzle is disposed in the immediate proximity of the generally convex surface, to its rear.

11 Claims, 3 Drawing Sheets

COATING PRODUCT SPRAYER DEVICE WITH ROTARY SPRAYER MEMBER

BACKGROUND OF THE INVENTION

1. Field of the Invention

The invention concerns a coating product sprayer device with a rotary sprayer member, for example a sprayer bowl rotating at high speed as commonly used in the automobile industry in particular; it is more particularly concerned with an improvement enabling quick and effective cleaning of all parts of the rotating member using a relatively small amount of cleaning product.

2. Description of the Prior Art

In the electrostatic painting art use is often made of rotating members for spraying the coating product, especially bowl-shape members. A rotating member of this kind is rotated at high speed (usually between 20,000 and 30,000 revolutions per minute) by a turbine and is held at a high voltage. The shape of the bowl is somewhat complex, which raises problems with cleaning. In the automobile industry cleaning in order to change the coating product must be quick. Cleaning is usually done by spraying a cleaning product (solvent) onto the various parts of the sprayer member while it is rotating at high speed. This raises various problems.

One is to clean the front part of the sprayer member, which requires the use of a mobile cleaning product sprayer nozzle to reach the front part, as it is not possible for the nozzle to remain in the jet of sprayed coating product between cleaning operations. It is therefore necessary to provide an actuator and an associated control system so that the nozzle can be retracted and a Venturi suction device to collect any droplets of the cleaning product which might escape during spraying. The operation of a mechanism of this kind is never entirely satisfactory because in a coating product sprayer installation the mechanisms which are moved only from time to time are characterized by poor reliability, because of stray sprayed material soiling the interfaces.

Another problem is that of splashing when the cleaning product is sprayed onto the bowl rotating at high speed. To prevent such splashes reaching adjacent parts, and in particular the objects to be coated, French patent No. 1 245 081 proposes to carry out the cleaning inside an interceptor, a kind of mobile casing, which is moved axially by actuators to surround the sprayer member completely while it is sprayed with multiple jets of cleaning product from nozzles of which some move with the interceptor. The interceptor is provided with suction means for recovering and evacuating the cleaning product, entraining coating product residues. The equipment is bulky and costly. It is not reliable in operation for the reasons already explained.

The document DE-U-8607841 describes a rotating bowl sprayer device in which the frustoconical exterior surface of the bowl can be cleaned by divergent jets of solvent from nozzles in the support enclosing the drive means for the rotating bowl. The characteristics of liquids are such that this divergence can be achieved only by a jet sprayed in the form of droplets. The droplets are entrained by the air which is caused to rotate by the bowl, reducing efficiency. According to the teaching of this document, the sprayed solvent which impinges on the surface to be cleaned over substantially all of its axial length is then ejected radially by centrifugal force, which causes significant splashing.

The invention makes it possible to solve all these problems and proposes an arrangement without any mobile cleaning nozzle and/or interceptor. The equipment is therefore less costly and its operation is more reliable. A smaller quantity of cleaning product is used.

The invention is based on the surprising finding that splashing of the cleaning product due essentially to cleaning generally convex parts of the sprayer member can be eliminated (despite the centrifugal acceleration of several tens of thousands of $m/s^2$ which tends to eject the coating product radially) by exploiting other phenomena tending to hold the film of coating product onto the surface such as, feasibly, surface tension and the Coanda effect.

SUMMARY OF THE INVENTION

The invention consists in a coating product sprayer device comprising a rotatable sprayer member and at least one cleaning product nozzle fixed relative to said rotatable member and directed towards a generally convex surface thereof so that the jet from it impinges on said surface with a large angle of incidence, said nozzle being disposed in the immediate proximity of said generally convex surface, to the rear thereof.

The concept of the angle of incidence in this context has the same meaning as in optics. It is therefore the angle between the jet of cleaning liquid leaving the nozzle and the normal to said generally convex surface at the point of impact. In this context, "generally convex surface" means any surface of the rotating sprayer member such that the radial component of the centrifugal force tends to project outwardly a liquid on this surface, as compared with a concave surface for which the radial component of the centrifugal force tends rather to force the liquid against said surface. If the sprayer member is generally bowl-shape, the generally convex surface is the exterior surface of said bowl and, where applicable, an approximately conical central protuberance, extending axially from a disk perpendicular to the rotation axis and set back relative to the sprayer edge of the bowl.

In this latter case the cleaning product sprayer nozzle is to the rear of the disk, which comprises a ring of holes along a circular contour in the vicinity of the base of the protuberance, and the nozzle is so oriented that part of the cleaning liquid jet which is not intercepted by the disk encounters the protuberance at a required angle of incidence in order to clean the protuberance. The cleaning liquid intercepted by the disk, and in particular by the side walls of the holes through it, cleans the exterior front surface of the disk. The axes of the holes may be inclined in a kind of helical arrangement to reduce the jet interception time. The jet axis may also be inclined (in the direction of rotation of the rotating member) to produce a component of its speed in the same direction as the rotation. It may also be advantageous for the front surface of the disk to be very slightly concave as the normal component of the centrifugal force on the product then improves the cleaning effect.

The invention will be better understood and other advantages of the invention will emerge more clearly from the following description of a device in accordance with the invention given by way of example only and with reference to the appended diagrammatic drawings.

DESCRIPTION OF THE PREFERRED EMBODIMENT

Figure 5:
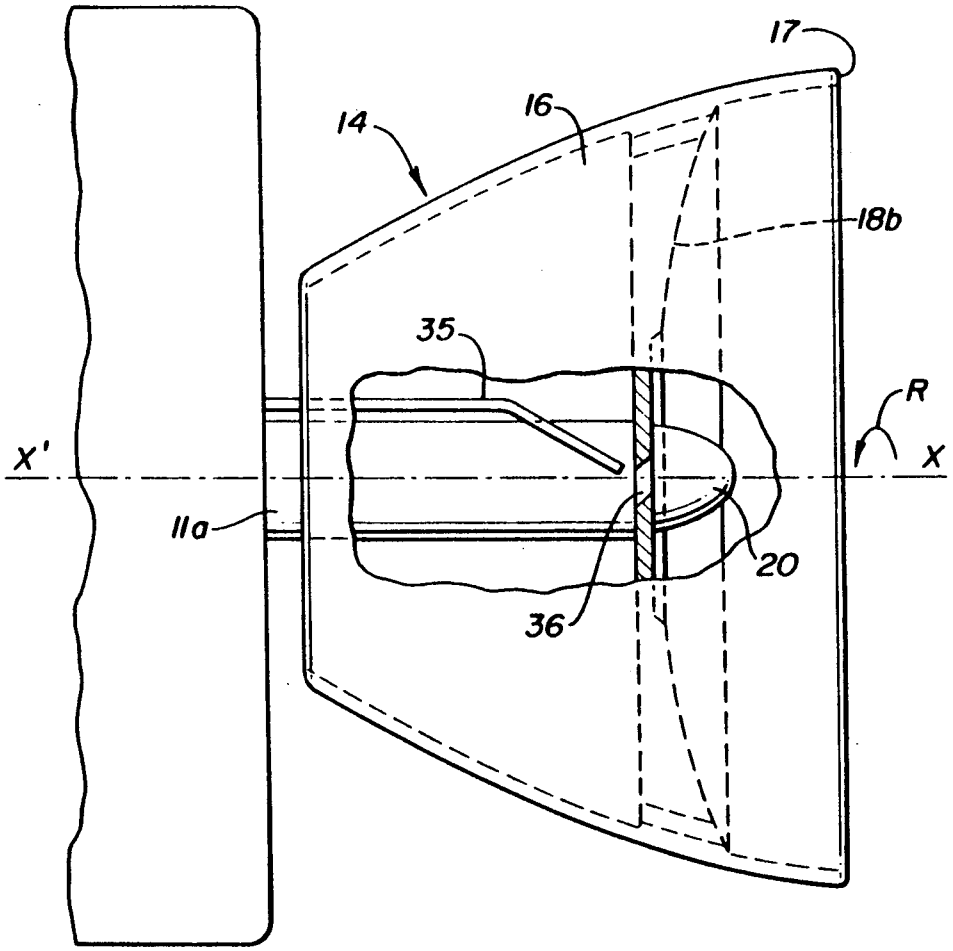
FIG. 5 is a view generally similar to that of FIG. 3 illustrating several details of embodiments of the present invention.

The drawings show the end part of a coating product sprayer device comprising a turbine 11 housed in a support casing 12 and whose rotary shaft 11*a* projects from the casing and carries a sprayer member 14 whose exterior is approximately bowl-shape. In operation the bowl is held at a high voltage. This type of sprayer member has an approximately frustoconical exterior surface 16 terminating at the end facing the object to be coated at a sprayer edge 17 and a disk 18 generally perpendicular to the rotation axis x'x of the sprayer member and set back relative to the sprayer edge 17. The disk merges with the interior surface of the bowl and its interior surface 18*a* is extended in the axial direction by a fixed hub 19 attached to the end of the shaft 11*a* of the turbine. The exterior surface 18*b* of the disk includes or carries an approximately conical protuberance 20, rounded at the apex, the known function of which is to minimize unwanted deposit of coating product on the disk and to enable the center of the front surface to be cleaned from the rear of the bowl. Holes 22 are formed in the disk along a circular contour in the vicinity of the junction between the disk and the interior surface of the bowl. As previously mentioned, the surface 18*b* of the disk may be slightly concave at points radially outside said protuberance as shown in FIG. 5. The extent of this concavity may be between 3 and 5 mm.

The coating product is deposited onto the interior surface of the disk by a fixed nozzle 24 carried by the support casing 12 and inserted into the space 26 between the interior surface of the bowl and the interior surface of the disk. Due to centrifugal force, the coating product deposited onto the interior surface 18*a* moves towards the periphery of the disk, passes through the holes 22 and continues to move along the interior wall of the bowl until it is sprayed from the sprayer edge 17. The support casing 12 houses compressed air supply means 27, for example an annular chamber comprising a multitude of air ejector holes 27*a* disposed along a circular contour to the rear of the rotating member 14 in order to create an "air envelope" entraining the particles of coating product in the forward direction.

The sprayer member as described up to this point is known in the prior art. In this type of rotating sprayer member there are two "generally convex" surfaces as herein defined. They are the exterior surface 16 of the bowl-shape part and the surface of the protuberance 20. A liquid deposited onto either of these surfaces tends to be expelled from said surface by centrifugal force when the sprayer member is rotated at high speed. The invention is based on the surprising finding that, even at the very high speeds employed, this radial component of the centrifugal force can be compensated if the liquid is sprayed with an appropriate angle of incidence which probably favors other phenomena, such as the Coanda effect or surface tension, able to maintain at least a substantial part of the liquid in contact with said generally convex surface. The invention exploits this finding to clean the rotating member with virtually no splashing.

In accordance with the invention, at least one cleaning product nozzle is provided, fixed relative to the support 12, that is to say carried by it, and directed towards said "generally convex" surface with an orientation such that the jet of cleaning liquid impinges on this surface with a large angle of incidence.

A cleaning product nozzle 28 is provided to the rear of the sprayer member and oriented towards the surface 16 so that the angle of incidence $a_1$ defined above is large. Good results can be obtained in practise with an angle of incidence of at least approximately 20°. However, this value does not constitute an absolute lower limit. With this angle of incidence and a sufficiently high rate of ejection of the cleaning product, and also because the nozzle 28 is in the immediate proximity of the rear of said generally convex surface (a few millimeters away from it), the cleaning product is observed to move in the forward direction along the exterior surface 16. The cleaning product remains in the form of a jet, rather than a spray, until it impinges on the exterior surface 16.

Figure 1:
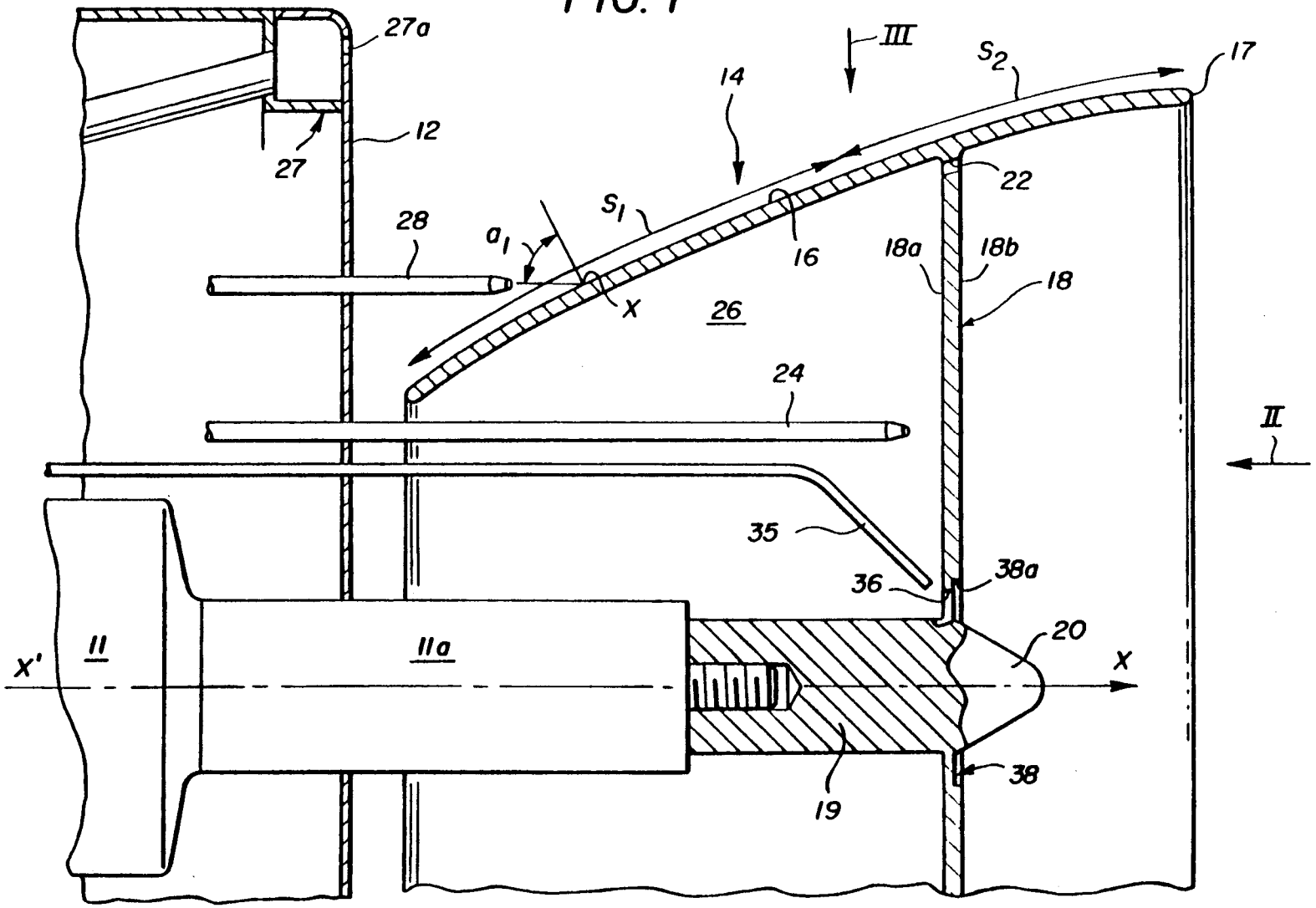
FIG. 1 is a partial cross-section of part of a coating product sprayer device in accordance with the invention in a plane passing through the rotation axis of the rotating member.
Figure 3:
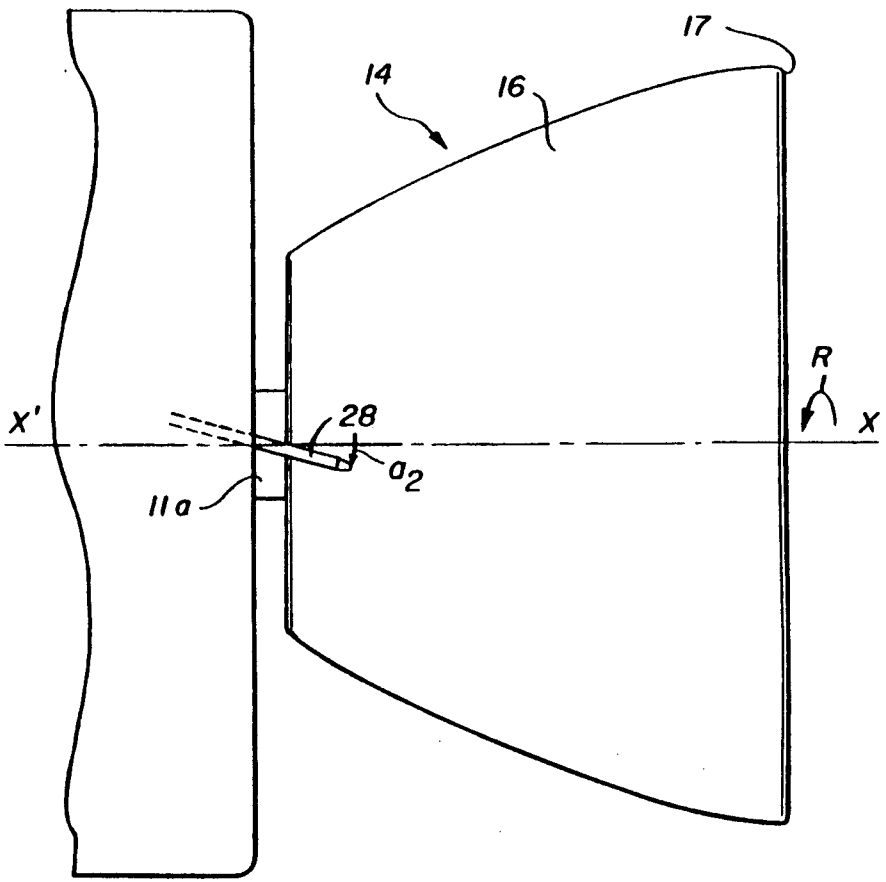
FIG. 3 is another view of the same device as seen in the direction of the arrow III in FIG. 1.

Independently of the angle of incidence $a_1$, the nozzle 28 may be oriented so that the jet of cleaning liquid is included in a plane which does not include the rotation axis. The angle $a_2$ between this plane and the x'x axis is such that the jet of liquid impinges on the exterior surface 16 slightly obliquely and in the rotation direction R of the bowl, as can be seen clearly in FIGS. 2 and 3. The jet from this nozzle therefore has a component of speed in the same direction as the rotation of the bowl.

Also, the air blowing means 27 are arranged so that the orifices 27*a* are at a radial distance from the o rotation axis x'x which is greater than the radial distance to the nozzle 28. In other words, the jet of cleaning liquid from the nozzle 28 is inside the air envelope created by the air blowing means 27. This has specific advantages.

As already explained, some of the cleaning liquid moves towards the sprayer edge 17, remaining on the surface 16 for as long as the effects of centrifugal force are compensated for by the other phenomena mentioned. It is estimated that a section $S_1$ of the surface 16 is therefore cleaned directly by the cleaning liquid from the nozzle 28. Beyond this point the cleaning liquid tends to leave the surface 16 but the air envelope created by the air blowing means 27 tends to return it to the section $S_2$ nearest the edge 17.

Similarly, at the point of impact X of the cleaning product on the bowl some of the liquid escapes from the surface 16 in the form of large droplets. These small splashes are broken up into much finer droplets on encountering the air envelope from the holes 27*a* and the mixture of air and cleaning product is deposited onto the section $S_2$ of the bowl, so helping to clean it.

Finally, note that the nozzle 28 is in an area of reduced pressure due to the proximity of the rotating bowl and the air envelope. If a droplet of the cleaning product should escape during application of the coating product it is captured by the bowl and sprayed without causing any apparent defect on the object.

Another cleaning product nozzle 35 is oriented towards the surface of the protuberance 20. It is inside the space 26 and therefore to the rear of the disk 18, which comprises a ring of holes 36 formed along a circular contour in the vicinity of the base of said protuberance 20. The end portion of the nozzle 35 is near the disk 18 and angled inwardly to "aim" it at the surface of the protuberance through the holes 36. In this way some of the cleaning liquid which is not intercepted by the disk spreads over the surface of the protuberance 20 in a way analogous to that already described. The angle of incidence is large, in the vicinity of 90°.

The cleaning product which is intercepted by the disk cleans both sides 18*a*, 18*b* of the disk. The liquid which is intercepted by the surface 18*a* itself (impinging on the disk between the holes 36) is evacuated in contact with this rear surface and therefore cleans it, before passing through the holes 22 and flowing to the sprayer edge 17. On the other hand, the cleaning liquid which is intercepted by the side walls of the holes 36 is evacuated essentially by flowing over the front surface 18*b* of the disk.

To improve the cleaning of the front surface 18*b* it may be necessary to favor the flow towards the front surface of the liquid intercepted by the side walls of the holes. To this end the holes in the ring of holes formed in the disk are divergent, from the rear towards the front, relative to the bowl rotation axis x'x. The jet of liquid remains convergent, however, because of the inclination of the nozzle 35.

Figure 2:
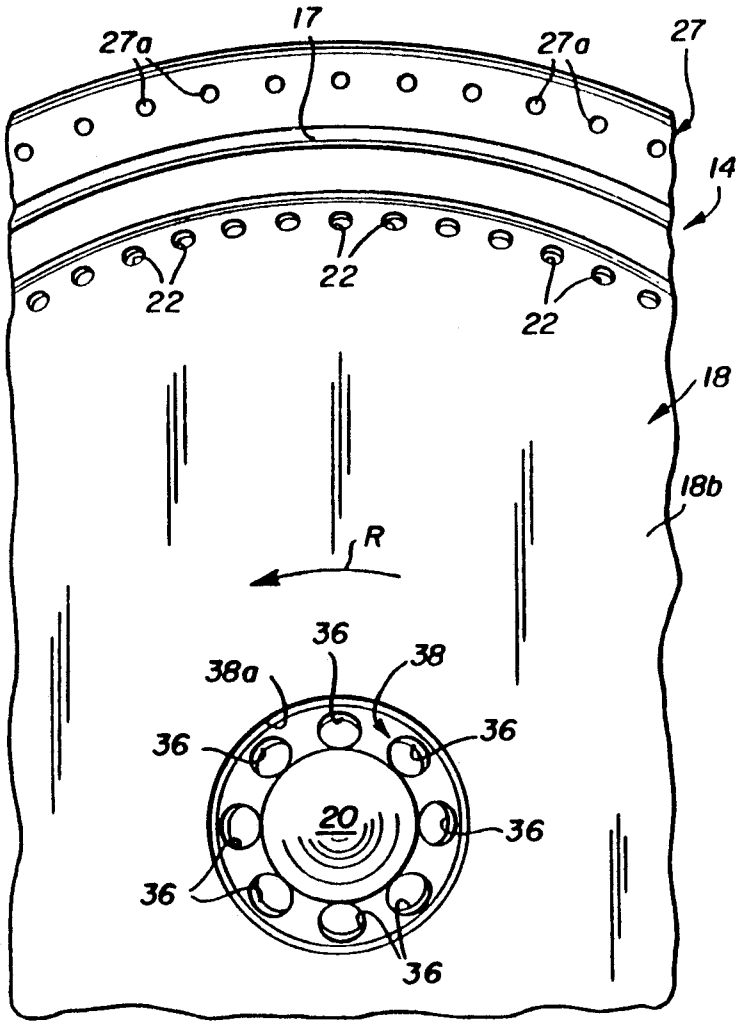
FIG. 2 is a partial front view of the sprayer device from FIG. 1 as seen in the direction of the arrow II in FIG. 1.
Figure 4:
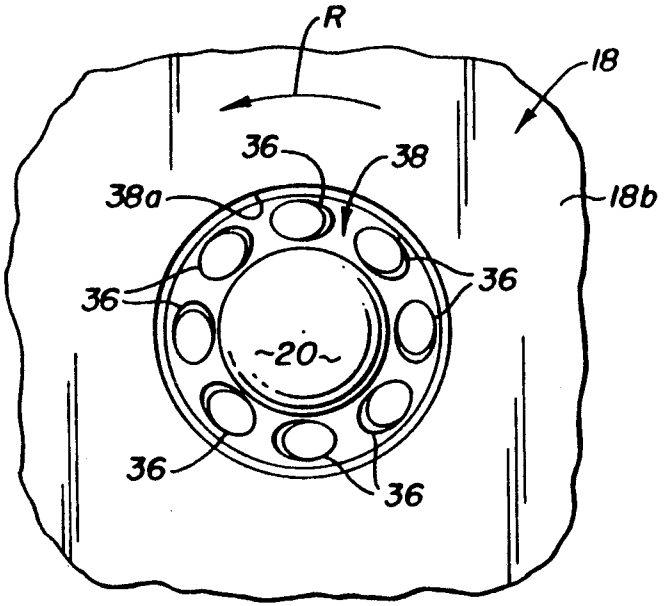
FIG. 4 is a view similar to that of FIG. 2 illustrating a modified version of the embodiment of FIG. 2.

What is more, on the front surface 18*b* of the disk the holes 36 discharge into the bottom of a groove 38 surrounding said protuberance 20. This groove, and in particular its exterior side wall 38*a* which is frustoconical, homogenizes the cleaning product intercepted by the holes. In one feasible embodiment eight equi-angularly spaced cylindrical holes 36 are formed in a ring (FIG. 2). To increase the proportion of the product which cleans the protuberance 20 a smaller number of curved oblong holes may be provided along the same circumferential contour. Likewise, the axis of each hole 36 may be inclined in a kind of helical arrangement, as shown in FIGS. 4 and 5, and the axis of the jet from the nozzle 35 may be oriented so that the speed of the jet has a component in the same direction as the speed of the rotating member, as shown in FIG. 5.

There is claimed:

1. A coating product sprayer device comprising a rotatable sprayer member and at least one cleaning product nozzle fixed relative to said rotatable member and directed towards a generally convex surface thereof so that the jet from it impinges on said surface with a large angle of incidence, said at least one nozzle being disposed in the immediate proximity of said generally convex surface, to the rear thereof, wherein said rotatable member includes a disk generally perpendicular to the rotation axis and set back relative to the front edge of said rotatable member, a central part of the exterior surface of said disk defining a protuberance having a convex surface constituting the generally convex surface of said rotatable member, said at least one nozzle is oriented towards the surface of said protuberance, said at least one nozzle is disposed to the rear of said disk and said disk comprises a ring of holes formed along a circular contour in the vicinity of the base or said protuberance, said at least one nozzle being so oriented that part of the jet of cleaning product passes through said holes and impinges on said protuberance.

2. The device according to claim 1 wherein said holes in said disk are divergent in the direction from the rear towards the front relative to the rotation axis of said rotatable member.

3. The device according to claim 1 wherein said holes in said disk discharge onto the front surface of said disk at the bottom of a groove surrounding said protuberance.

4. The device according to claim 3 wherein said groove has a frustoconical exterior side surface.

5. Device according to claim 1 wherein said exterior surface of said disk is slightly concave in the part radially beyond said protuberance.

6. Device according to claim 1 wherein the axis of each hole in said disk is oriented in a helical arrangement.

7. Device according to claim 1 wherein said second nozzle is so oriented that the jet from said second nozzle has a component of speed in the same direction as that of said rotatable member.

8. A coating product sprayer device comprising a rotatable sprayer member having a generally convex surface and at least one cleaning product nozzle fixed relative to said rotatable member and directed towards the generally convex surface, said at least one cleaning product nozzle having an outlet disposed in the immediate proximity of said generally convex surface and being constructed and oriented for directing, while said rotatable member rotates, a substantially spray-free jet of liquid cleaning product onto the generally convex surface with a large angle of incidence selected to substantially prevent expulsion of liquid cleaning product from the generally convex surface due to centrifugal force produced during rotation of said rotatable member.

9. The device according to claim 8 wherein said at least one nozzle is disposed to the rear of said rotatable member and is oriented towards the front of said rotatable member and towards the exterior surface of said rotatable member.

10. The device according to claim 9 wherein said at least one nozzle is so oriented that the direction of the jet of cleaning product is included in a plane which does not includes the axis of rotation of said rotatable member and so that the jet from said nozzle has a component of speed in the same direction as the rotation of said rotatable member.

11. The device according to claim 9 comprising air blower means disposed in an annular configuration coaxial with said rotatable member and to the rear thereof so that the blown air substantially envelopes said rotatable member and wherein said at least one nozzle is at a radial distance from the rotation axis less than the radial distance from the rotation axis at which air is blown from said air blower means.

* * * * *